US009217590B2

(12) United States Patent
Cogswell et al.

(10) Patent No.: US 9,217,590 B2
(45) Date of Patent: Dec. 22, 2015

(54) EJECTOR CYCLE

(75) Inventors: Frederick J. Cogswell, Glastonbury, CT (US); Hongsheng Liu, Shanghai (CN); Parmesh Verma, Manchester, CT (US); Oliver Finckh, Frankfurt (DE)

(73) Assignee: United Technologies Corporation, Hartford, CT (US)

( * ) Notice: Subject to any disclaimer, the term of this patent is extended or adjusted under 35 U.S.C. 154(b) by 577 days.

(21) Appl. No.: 13/375,218

(22) PCT Filed: Jan. 4, 2011

(86) PCT No.: PCT/CN2011/000002

§ 371 (c)(1),
(2), (4) Date: Nov. 29, 2011

(87) PCT Pub. No.: WO2012/092686

PCT Pub. Date: Jul. 12, 2012

(65) Prior Publication Data

US 2012/0167601 A1 Jul. 5, 2012

(51) Int. Cl.
*F25B 1/00* (2006.01)
*F25B 41/00* (2006.01)
(Continued)

(52) U.S. Cl.
CPC . *F25B 41/00* (2013.01); *F25B 1/10* (2013.01); *F25B 41/043* (2013.01);
(Continued)

(58) Field of Classification Search
CPC ..... F25B 2341/0013
USPC ..... 62/115, 500, 116, 175, 192.2, 510, 191
See application file for complete search history.

(56) References Cited

U.S. PATENT DOCUMENTS 1,836,318 A 12/1931 Gay
2,461,342 A * 2/1949 Obreiter, Jr. ..... 62/503
(Continued)

FOREIGN PATENT DOCUMENTS

CN 1475716 A 2/2004
CN 101329115 A 12/2008
(Continued)

OTHER PUBLICATIONS

GF Piping Systems, "Three-Way Ball Valve Type", retreived on Oct. 2014 from www.gfps.com.*
(Continued)

*Primary Examiner* — Cheryl J Tyler
*Assistant Examiner* — Orlando E Aviles Bosques
(74) *Attorney, Agent, or Firm* — Bachman & LaPointe, P.C.

(57) ABSTRACT

A system (200; 300; 400; 500; 600) has a compressor (22; 200, 221). A heat rejection heat exchanger (30) is coupled to the compressor to receive refrigerant compressed by the compressor. An ejector (38) has a primary inlet (40) coupled to the heat rejection heat exchanger to receive refrigerant, a secondary inlet (42), and an outlet (44). A separator (48) has an inlet (50) coupled to the outlet of the ejector to receive refrigerant from the ejector, a gas outlet (54), and a liquid outlet (52). One or more valves (244, 246, 248, 250) are positioned to allow switching of the system between first and second modes. In the first mode: refrigerant passes from the heat rejection heat exchanger, through the ejector primary inlet, out the ejector outlet, to the separator; a first flow from the separator gas outlet passes through the compressor to the heat rejection heat exchanger; and a second flow from the separator liquid outlet passes through a heat absorption heat exchanger (64) and through the ejector secondary port. In the second mode: refrigerant passes from the heat rejection heat exchanger to the separator; a first flow from the separator gas outlet passes to the compressor; and a second flow from the separator liquid outlet passes through the heat absorption heat exchanger to the compressor.

23 Claims, 15 Drawing Sheets

(51) Int. Cl.
*F25B 1/10* (2006.01)
*F25B 41/04* (2006.01)

(52) U.S. Cl.
CPC .. *F25B 2309/061* (2013.01); *F25B 2341/0012* (2013.01); *F25B 2341/0662* (2013.01); *F25B 2400/13* (2013.01); *F25B 2400/23* (2013.01); *F25B 2500/31* (2013.01); *F25B 2600/2519* (2013.01)

(56) References Cited

U.S. PATENT DOCUMENTS

| | | | | |
|---|---|---|---|---|
| 3,238,738 | A * | 3/1966 | Webber | 62/510 |
| 3,277,660 | A | 10/1966 | Kemper et al. | |
| 4,179,248 | A * | 12/1979 | Shaw | 62/510 |
| 4,306,420 | A * | 12/1981 | Cann | 62/196.2 |
| 4,324,105 | A * | 4/1982 | Cann | 62/196.2 |
| 5,740,681 | A * | 4/1998 | Karl | 62/324.6 |
| 6,112,547 | A * | 9/2000 | Spauschus et al. | 62/476 |
| 7,178,359 | B2 | 2/2007 | Oshitani et al. | |
| 8,783,060 | B2 * | 7/2014 | Nishijima et al. | 62/500 |
| 2002/0066278 | A1 * | 6/2002 | Cho et al. | 62/114 |
| 2003/0140651 | A1 * | 7/2003 | Takeuchi et al. | 62/500 |
| 2003/0192338 | A1 * | 10/2003 | Manohar et al. | 62/498 |
| 2004/0003608 | A1 * | 1/2004 | Takeuchi et al. | 62/500 |
| 2004/0123624 | A1 | 7/2004 | Ohta et al. | |
| 2004/0206111 | A1 * | 10/2004 | Ikegami et al. | 62/500 |
| 2004/0255602 | A1 * | 12/2004 | Sato et al. | 62/159 |
| 2005/0028552 | A1 * | 2/2005 | Nishijima et al. | 62/500 |
| 2006/0254308 | A1 * | 11/2006 | Yokoyama et al. | 62/500 |
| 2007/0028630 | A1 | 2/2007 | Yamada et al. | |
| 2007/0180852 | A1 * | 8/2007 | Sugiura et al. | 62/500 |
| 2008/0196446 | A1 | 8/2008 | Nakamura et al. | |
| 2010/0257893 | A1 * | 10/2010 | Oshitani et al. | 62/500 |
| 2010/0313582 | A1 * | 12/2010 | Oh et al. | 62/115 |
| 2011/0203309 | A1 | 8/2011 | Okazaki | |

FOREIGN PATENT DOCUMENTS

| | | | |
|---|---|---|---|
| JP | 2007078349 | A | 3/2007 |
| WO | 2008105763 | A1 | 9/2008 |
| WO | 2010038762 | A1 | 4/2010 |

OTHER PUBLICATIONS

Translation of Description of CN1475716 retrieved on Mar. 2015.*
ISR and Written Opinion of ISA/CN for PCT/CN2011/000002, dated Oct. 20, 2011.
Chinese Office Action for Chinese Patent Application No. 201180064120.2, dated Nov. 4, 2014.

* cited by examiner

EJECTOR CYCLE

BACKGROUND

The present disclosure relates to refrigeration. More particularly, it relates to ejector refrigeration systems.

Earlier proposals for ejector refrigeration systems are found in U.S. Pat. No. 1,836,318 and U.S. Pat. No. 3,277,660. FIG. 1 shows one basic example of an ejector refrigeration system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary inlet (liquid or supercritical or two-phase inlet) 40 of an ejector 38. The ejector 38 also has a secondary inlet (saturated or superheated vapor or two-phase inlet) 42 and an outlet 44. A line 46 extends from the ejector outlet 44 to an inlet 50 of a separator 48. The separator has a liquid outlet 52 and a gas outlet 54. A suction line 56 extends from the gas outlet 54 to the compressor suction port 24. The lines 28, 36, 46, 56, and components therebetween define a primary loop 60 of the refrigerant circuit 27. A secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62 and expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary inlet 40 via the line 36.

The exemplary ejector 38 (FIG. 2) is formed as the combination of a motive (primary) nozzle 100 nested within an outer member 102. The primary inlet 40 is the inlet to the motive nozzle 100. The outlet 44 is the outlet of the outer member 102. The primary refrigerant flow 103 enters the inlet 40 and then passes into a convergent section 104 of the motive nozzle 100. It then passes through a throat section 106 and an expansion (divergent) section 108 through an outlet 110 of the motive nozzle 100. The motive nozzle 100 accelerates the flow 103 and decreases the pressure of the flow. The secondary inlet 42 forms an inlet of the outer member 102. The pressure reduction caused to the primary flow by the motive nozzle helps draw the secondary flow 112 into the outer member. The outer member includes a mixer having a convergent section 114 and an elongate throat or mixing section 116. The outer member also has a divergent section or diffuser 118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability).

The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (not shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and other system components.

Various modifications of such ejector systems have been proposed. One example in US20070028630 involves placing a second evaporator along the line 46. US20040123624 discloses a system having two ejector/evaporator pairs. Another two-evaporator, single-ejector system is shown in US20080196446. Another method proposed for controlling the ejector is by using hot-gas bypass. In this method a small amount of vapor is bypassed around the gas cooler and injected just upstream of the motive nozzle, or inside the convergent part of the motive nozzle. The bubbles thus introduced into the motive flow decrease the effective throat area and reduce the primary flow. To reduce the flow further more bypass flow is introduced.

SUMMARY

One aspect of the disclosure involves a system having a compressor. A heat rejection heat exchanger is coupled to the compressor to receive refrigerant compressed by the compressor. An ejector has a primary inlet coupled to the heat rejection heat exchanger to receive refrigerant, a secondary inlet, and an outlet. A separator has an inlet coupled to the outlet of the ejector to receive refrigerant from the ejector, a gas outlet, and a liquid outlet. One or more valves are positioned to allow switching of the system between first and second modes. In the first mode: refrigerant passes from the heat rejection heat exchanger, through the ejector primary inlet, out the ejector outlet, to the separator; a first flow from the separator gas outlet passes through the compressor to the heat rejection heat exchanger; and a second flow from the separator liquid outlet passes through a heat absorption heat exchanger and through the ejector secondary port. In the second mode: refrigerant passes from the heat rejection heat exchanger, through the ejector primary inlet, out the ejector outlet, to the separator; a first flow from the separator gas outlet passes to the compressor; and a second flow from the separator liquid outlet passes through the heat absorption heat exchanger to the compressor bypassing the ejector.

Other aspects of the disclosure involve methods for operating the system.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
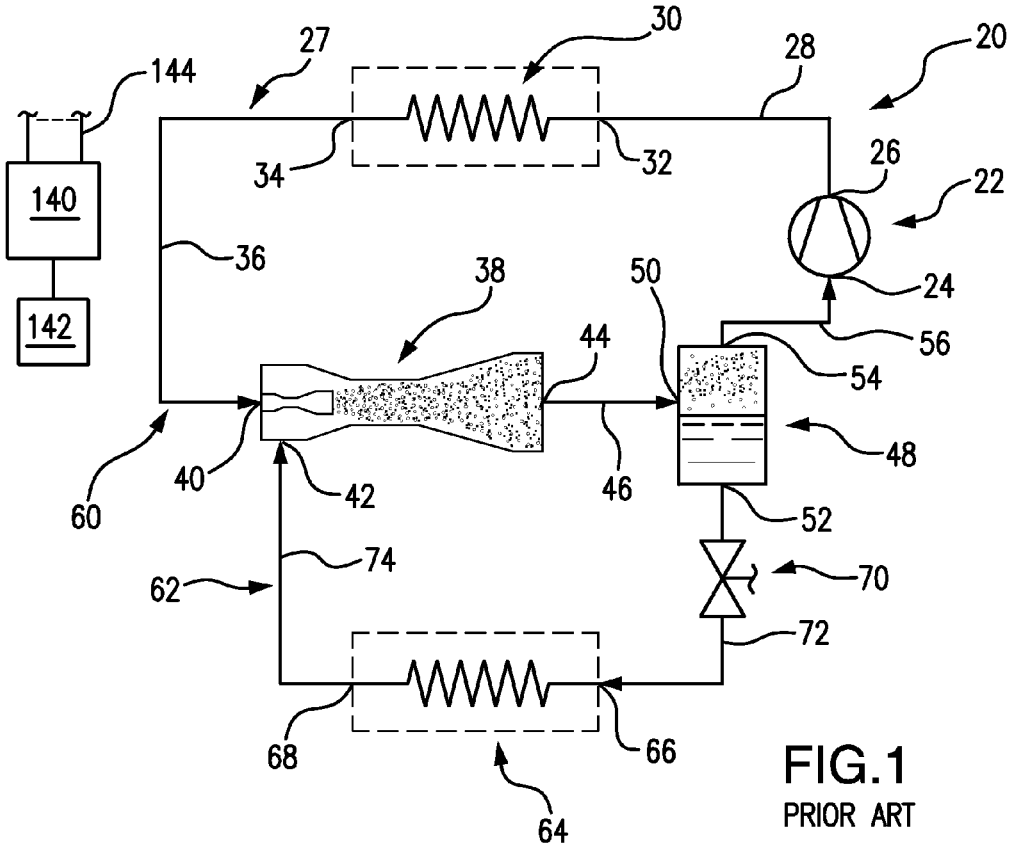
FIG.1 PRIOR ART
FIG. 1 is a schematic view of a prior art ejector refrigeration system.
Figure 2:
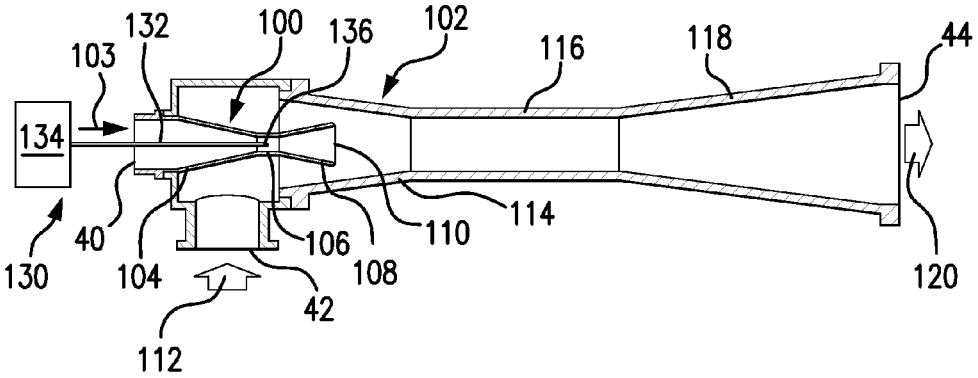
FIG. 2 PRIOR ART
FIG. 2 is an axial sectional view of an ejector.
Figure 3:
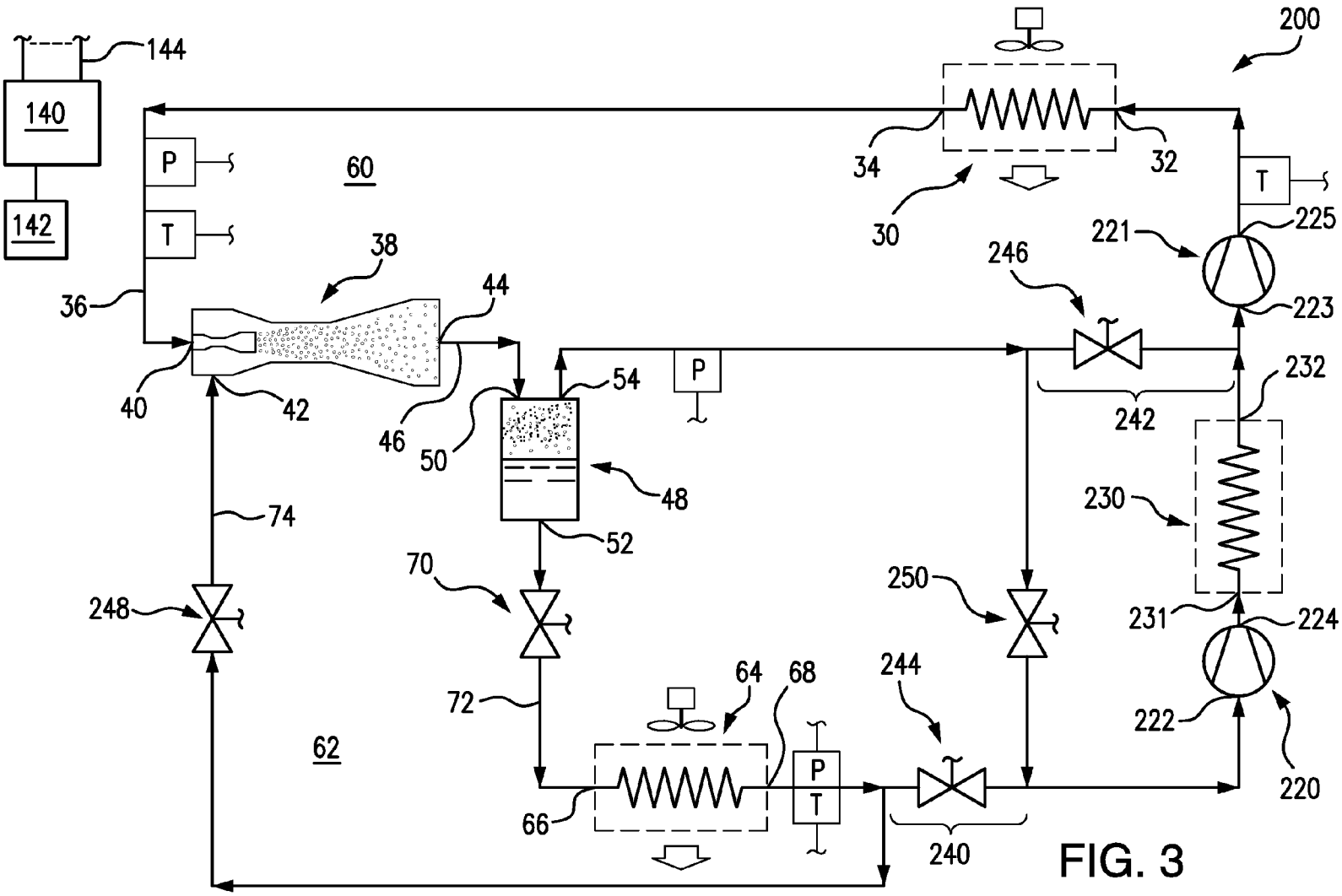
FIG. 3 is a schematic view of a first refrigeration system in a first mode of operation.

FIG. 3 shows an ejector cycle vapor compression (refrigeration) system 200. The system 200 may be made as a modification of the system 20 or of another system or as an original manufacture/configuration. In the exemplary embodiment, like components which may be preserved from the system 20 are shown with like reference numerals. Operation may be similar to that of the system 20 (or other baseline system) except as discussed below with the controller controlling operation responsive to inputs from various temperature sensors and pressure sensors. The system can operate in two modes: a first mode behaves relatively like the baseline ejector system (operating the ejector as an ejector); the second mode operates more as an economized non-ejector system.

To provide the dual modes of operation (more modes are possible, especially with more complicated implementations), the compressor 22 is replaced by a first compressor 220 and a second compressor 221 having respective inlets 222, 223 and outlets 224, 225. The exemplary embodiment makes use of this division of compression to add an intercooler 230 between the compressors. In an exemplary embodiment, the compressors 220 and 221 represent sections of a single larger compressor. For example, the first compressor 220 may represent two cylinders of a three-cylinder reciprocating compressor coupled in parallel or in series to each other. The second compressor 221 may represent the third cylinder. In that embodiment, the speed of the two compressors will always be the same. In alternative embodiments, the compressors may have separate motors and may be separately controlled (e.g., to different relative speeds depending upon operating condition).

Figure 4:
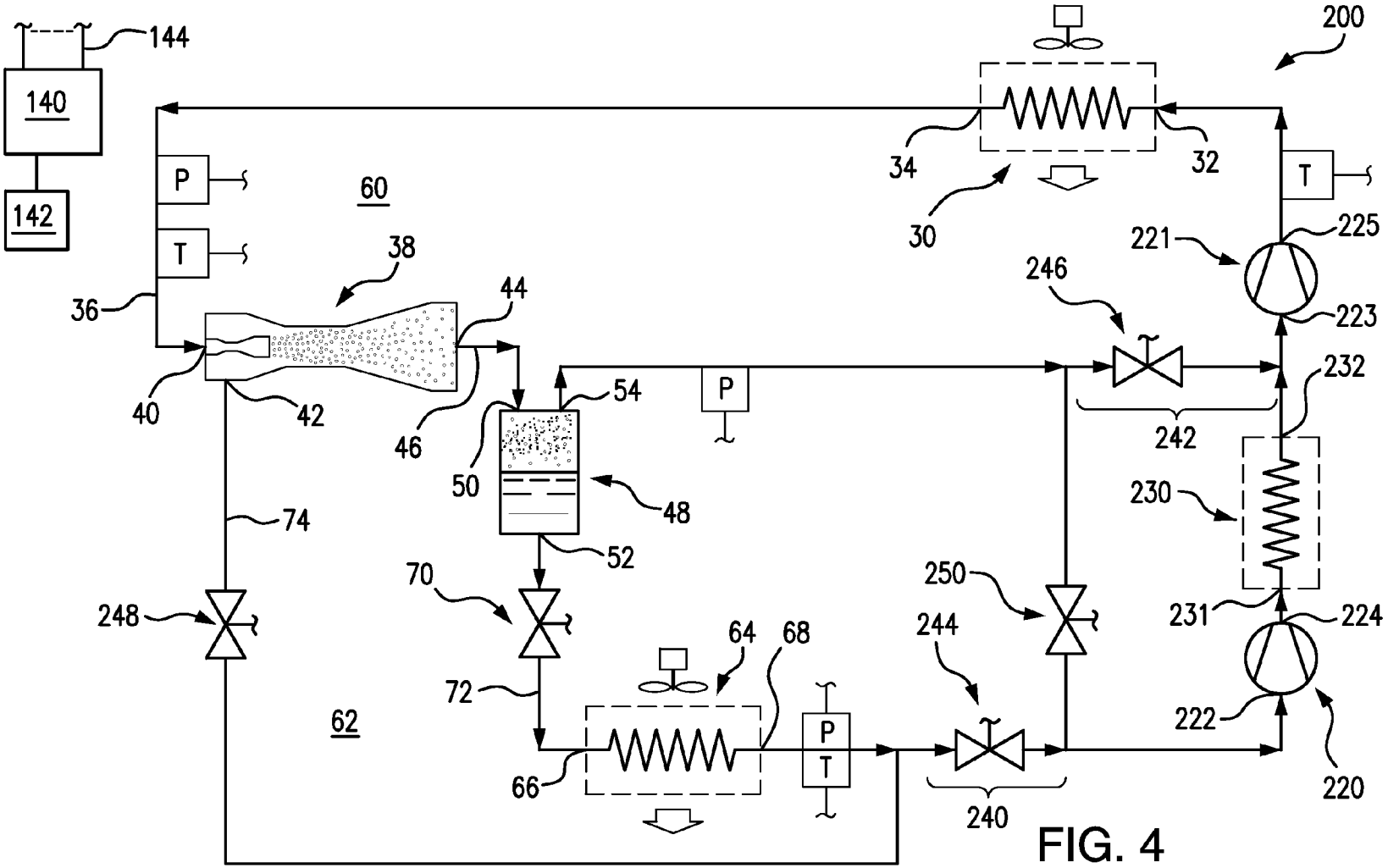
FIG. 4 is a schematic view of the first refrigeration system in a second mode of operation.

Also to provide the dual modes of operation an additional two flowpath branches 240 and 242 are added to pass refrigerant in the second mode (FIG. 4) and valves 244 and 246 (e.g., bistatic on-off solenoid valves) are provided along these branches for selectively blocking (first mode) and unblocking (second mode) those branches. Similarly, valves 248 and 250 (e.g., bistatic on-off solenoid valves) are provided to selectively unblock (first mode) and block (second mode) associated portions of the baseline flowpath. Valve 248 is positioned to block the secondary flow through the ejector in the second mode (e.g., it is in the secondary loop downstream of the evaporator 64). Valve 250 is positioned between the gas outlet 54 and the first compressor suction port 222 to block flow from the gas outlet to the first compressor in the second mode.

Flowpath branch 240 provides (with the valve 244 open) a branch to pass refrigerant from the evaporator outlet to the inlet of the first compressor in the second mode. Similarly, flowpath branch 242 provides (with the valve 246 open) a branch to pass refrigerant from the gas outlet 54 to the inlet of the second compressor in the second mode.

Figure 6:
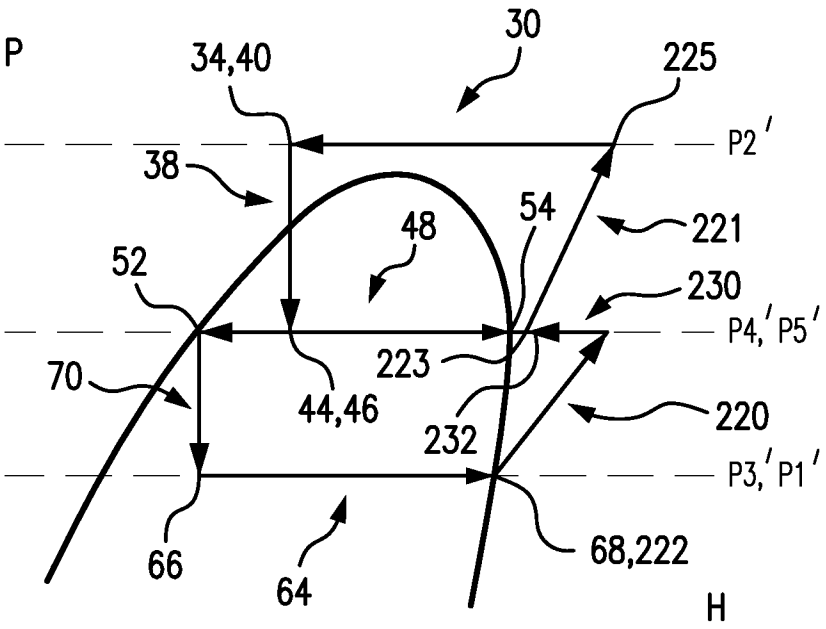
FIG. 6 is a simplified pressure-enthalpy diagram of the first refrigeration system in the second mode of operation.
Figure 5:
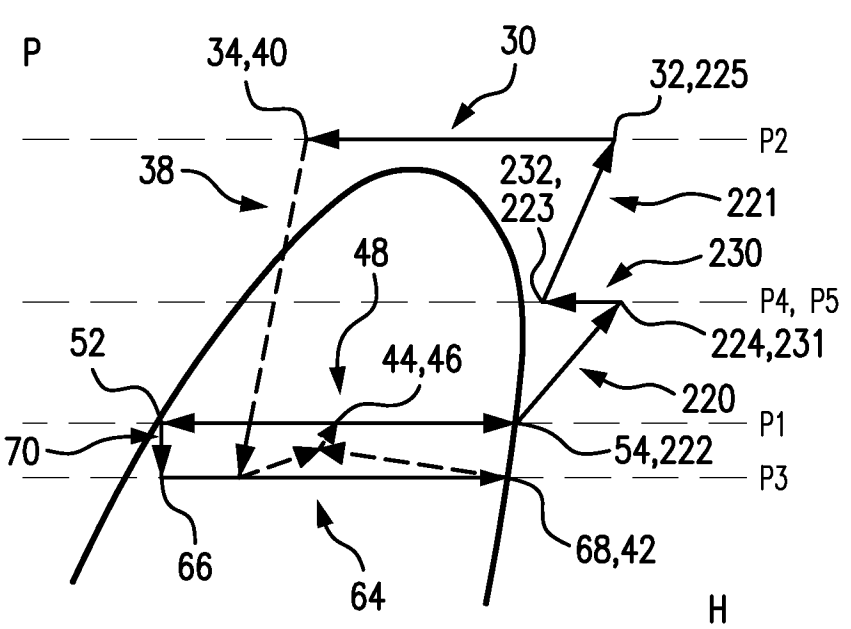
FIG. 5 is a simplified pressure-enthalpy diagram of the first refrigeration system in the first mode of operation.

FIGS. 5 and 6 are respective pressure-enthalpy diagrams for the system 200 in the first and second modes. FIG. 5 shows exemplary first mode pressures and enthalpies at various locations in the system. The first compressor's suction pressure is shown as P1. The second compressor compresses the gas to a discharge pressure P2 at increased enthalpy. The gas cooler 30 decreases enthalpy at essentially constant pressure P2 (the "high side" pressure). The evaporator 64 operates at a pressure P3 ("low side" pressure) below the suction pressure P1. The separator 48 operates at P1. The pressure lift ratio is provided by the ejector 38. The ejector 38 raises the pressure from P3 to P1. In the exemplary implementation, the separator 48 outputs pure (or essentially pure (single-phase)) gas and liquid from the respective outlets 54 and 52. In alternative implementations, the gas outlet may discharge a flow containing a minor (e.g., less than 50% by mass, or much less) amount of liquid and/or the liquid outlet may similarly discharge a minor amount of gas.

In this simplified depiction, the first compressor discharges at a pressure P4. The second compressor has a suction pressure P5 which is essentially equal thereto. The intercooler 230 may provide a small jog or disturbance in the P-H plot between the two compressors, reducing enthalpy at essentially constant pressure.

By providing the P3 to P1 additional pressure lift, the use of an ejector recovers refrigerant expansion losses and facilitates operation at a higher ambient temperature. For example, for many systems, ambient temperature is the most dynamically changing/varying input variable. An example is in refrigerated cargo containers or refrigerated trucks or trailers. The nature of the cargo may narrowly determine the desired compartment temperature (and thus the target operating evaporator temperature and pressure). At various different times, a given container may, however, be used for different cargo and thus may advantageously be capable of operating over a moderate range of different evaporator temperatures and pressures. However, that temperature is typically preset, whereas ambient temperature varies continuously and by great amounts. As ambient temperature drops, the advantages of the ejector are reduced.

The second mode of operation may be configured to provide advantages at lower ambient temperatures or other part-load conditions. For example, a full load condition may be characterized by a high ambient temperature with a high required cooling capacity; whereas, a part load condition may be characterized by a lower ambient temperature and lower required capacity. The ejector (especially a non-controllable or fixed ejector) may be sized or otherwise optimized for full load operation. Such an ejector may be inefficient at part load operation. Thus, the second mode may be a more efficient mode at low load given the particular ejector (but may be less efficient than operation with an ejector sized specifically for the lower load condition). This mode may resemble an economizer mode. In the FIG. 6 second mode of operation, the high side pressure is shown as P2', the low side pressure is shown as P3', and the first compressor's suction pressure is shown as P1' which is essentially equal to P3'. The first compressor discharges at a pressure P4'. The second compressor has a suction pressure P5' which is essentially equal to P4'. FIG. 6 also shows the intercooler exit 232 at slightly higher enthalpy than the separator (flash tank) gas outlet 54. The exemplary merged flows average out to form the enthalpy at the inlet 223 to the second compressor 221.

The controller may optimize system efficiency for a given operating condition (e.g., ambient temperature, container temperature, and desired capacity). The controller may do this by: a) switching between modes as defined above; and b) optimizing the parameters of its controllable devices. By continuously optimizing the system efficiency the power consumption required for a given application is minimized. During steady state operation, the control system may select the mode and iteratively optimize the settings of the controllable parameters within the selected mode to achieve a desired goal (e.g., minimize power consumption) which may be directly or indirectly measured. Alternatively, the control may be subject to pre programmed rules to achieve the desired results in the absence of real time optimization. The same optimization may be used during changing conditions (e.g., changing external temperature of a refrigeration system). Yet other methods may be used in other transition situations (e.g., cool down situations, defrost situations, and the like).

Switching between first and second modes may be responsive to user entered setpoints and sensed conditions. The sensed conditions may comprise or consist of: the outdoor ambient temperature; the actual container temperature; and the compressor speed (which is representative of capacity). For example, particular thresholds will depend upon the target container (or box or compartment) temperature (which may depend upon the particular goods being transported).

An exemplary control progression may proceed as follows. The unit is started with the container temperature equal to the ambient temperature and the ambient temperature is hot (38 C). The container setpoint temperature is −33 C. The unit starts in the first mode (ejector) because an economizer does not operate properly when the low-side pressure is high (if the intermediate pressure P4' is supercritical then the flash tank cannot work to separate liquid and vapor phases). As the container temperature decreases, the controller checks its switching setpoints (e.g., a map of which mode is more efficient as a function of ambient temperature, container temperature and compressor speed; such a map may be preprogrammed when the system is manufactured and may be based on experimental or calculated data) to determine when it is more efficient to be in the second (economizer) mode. In one example the economizer mode is more efficient only at low container temperatures. When the container temperature drops below this threshold (−21 C in this example) the controller switches from the first mode to the second mode.

In another example, the ambient temperature is lower and the economizer mode is more efficient at container temperatures below −4 C. In this case, the controller switches when the container temperature reaches 2 C.

In another example, the ambient temperature is high, but the container setpoint is at 2 C (e.g., a non-frozen perishable goods situation). When the container is cooled to 2 C, the controller reduces the capacity of the system by slowing the compressor speed. When the compressor speed reaches 50%, the ejector cycle efficiency equals the economizer efficiency and the mode is switched from the first mode to the second mode.

In the exemplary system the following actuators may be variable: 1) the compressor speed; 2) the orifice size of the expansion device 70; 3) the needle of the ejector 38; 4) the speed of the gas-cooler fan; and 5) the speed of the evaporator fan. In addition, if the two stage compressor consists of two separate compressors (rather than a single compressor with multiple cylinders doing separate stages), then each compressor stage may also be controlled independently. These controllable devices (variable actuators) together with the bistatic valves 244, 246, 248, 250 constitute the actuators that the controller may use to optimize system efficiency.

The four valves 244, 246, 248, and 250 are used in unison to switch the system between the first and second modes. In the first (ejector cycle) mode, valves 248 and 250 are open and valves 240 and 246 are closed. In the second (economizer) mode, valves 240 and 246 are open while valves 248 and 250 are closed.

A variable evaporator fan may be used to affect system capacity and efficiency. At low capacity, the fan may be slowed to reduce its power consumption with little affect on the compressor power consumption.

A variable gas-cooler (or condenser) fan may be used to affect system capacity and efficiency. Higher fan speed lowers the gas-cooler exit temperature thus improving system efficiency, but at the cost of higher fan power. At low-capacity and low-ambient temperature operating conditions, it may be advantageous to lower the fan speed.

The valve 70 (e.g., variable expansion valve) may be varied to control the state of the refrigerant exiting the outlet 68 of the evaporator 64. Control may be performed so as to maintain a target superheat at such outlet 68. The actual superheat may be determined responsive to controller inputs received from the relevant sensors (e.g., responsive to outputs of a temperature sensor and a pressure sensor between the outlet 68 and the ejector secondary inlet 42). To increase the superheat, the valve 70 is closed; to decrease the superheat, the valve 70 is opened (e.g., in stepwise or continuous fashion). In an alternate embodiment, the pressure can be estimated from a temperature sensor (not shown) along the saturated region of the evaporator. Controlling to provide a proper level of superheat ensures good system performance and efficiency. Too high a superheat value results in a high temperature difference between the refrigerant and air and, thus, results in a lower evaporator pressure. If the valve 70 is too open, the superheat may go to zero and the refrigerant leaving the evaporator will be saturated. Too low a superheat indicates that liquid refrigerant is exiting the evaporator. Such liquid refrigerant does not provide cooling and must be re pumped by the ejector. The target superheat value may differ depending on the operation mode. In the first mode, the target may be small (typically 2K), while in the second mode the target may be higher (typically 5K or more). The reason for this difference is that in the first mode the exit of the evaporator is connected to the ejector secondary inlet (suction port), whereas in the second mode it is connected to the compressor suction port. The ejector is tolerant of ingesting liquid refrigerant whereas the compressor may not be.

The variable ejector may act as a high pressure control valve (HPV) for both the ejector mode and the economizer mode.

For transcritical cycles such as $CO_2$, raising the high side pressure decreases the enthalpy out of the gas cooler and increases the cooling available for a given compressor mass flow rate. However, increasing the high side pressure also increases the compressor power. There is an optimum pressure value that maximizes the system efficiency at a given operating condition. Generally, this target value varies with the refrigerant temperature leaving gas cooler. A high side pressure temperature curve may be programmed in the controller.

In the exemplary embodiment with two compressors driven together (e.g., as separate groups of cylinders of a single compressor), the compressor speed may be varied to control overall system capacity. Increasing the compressor speed will increase the flow rate to the ejector and therefore to the evaporator. Increased flow to the evaporator directly increases system capacity. The desired capacity, and therefore compressor speed, may be determined by the difference between the box temperature and the box temperature setpoint. A standard PI (proportional-integral) logic may be used to determine the compressor speed from the time history of the error measured container temperature minus temperature setpoint.

Figure 7:
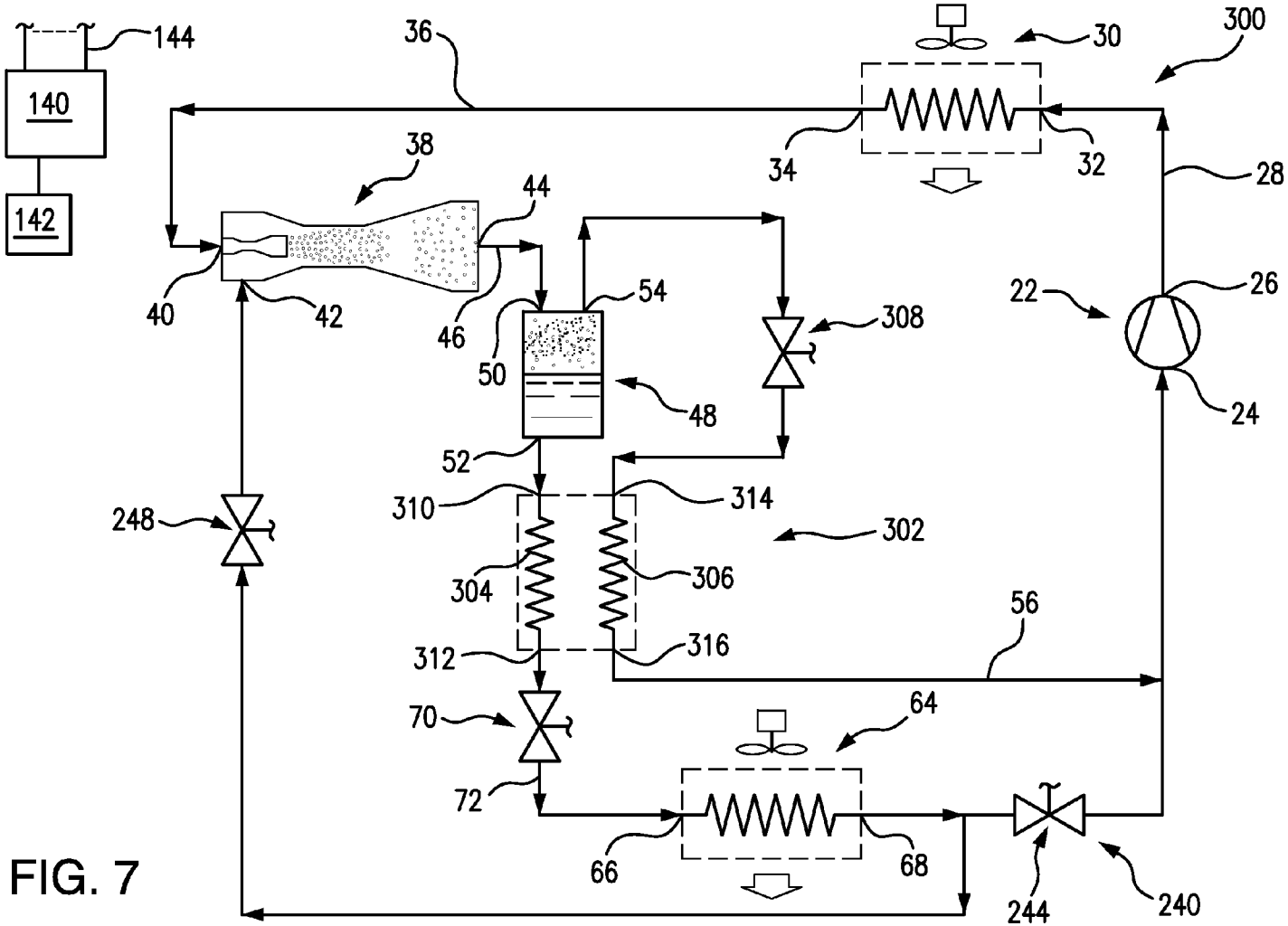
FIG. 7 is a schematic view of a second refrigeration system in a first mode of operation.

FIG. 7 shows an alternate system 300 which may share basic operational details with the system 20 and certain modifications with the system 200. The dual modes of operation are provided by addition of valves but not division or addition of compressors. An additional modification adds an economizer heat exchanger 302 with a first leg 304 having an inlet/upstream end 310 and an outlet/downstream end 312 along the line/conduit 72 between the separator liquid outlet 52 and the expansion device 70. The heat exchanger 302 has a second leg 306 (having an inlet/upstream end 314 and an outlet/downstream end 316) in heat exchange relation with the first leg. The second leg is located along a line (e.g., the compressor suction line 56) between the gas/vapor outlet 54 of the separate and the compressor suction port 24. A second expansion device 308 (e.g., EEV) is located in the line 56 between the separator gas outlet 54 and the second leg 306.

In a similar modification to that found in the system 200, an additional flowpath branch 240 is added with a valve 244 positioned for selectively blocking and unblocking flow along this branch. A valve 248 is provided to selectively unblock and block the secondary flow through the ejector. In the first mode of operation (a pure ejector mode), the valve 244 is closed and the valve 248 is open. Flow proceeds as in the system 20. However, the presence of the economizer heat exchanger 302 is effectively deactivated by keeping the valve 308 fully open. Thus, the temperature along both legs 306 and 304 will be essentially the same and there will be no heat transfer.

Figure 8:
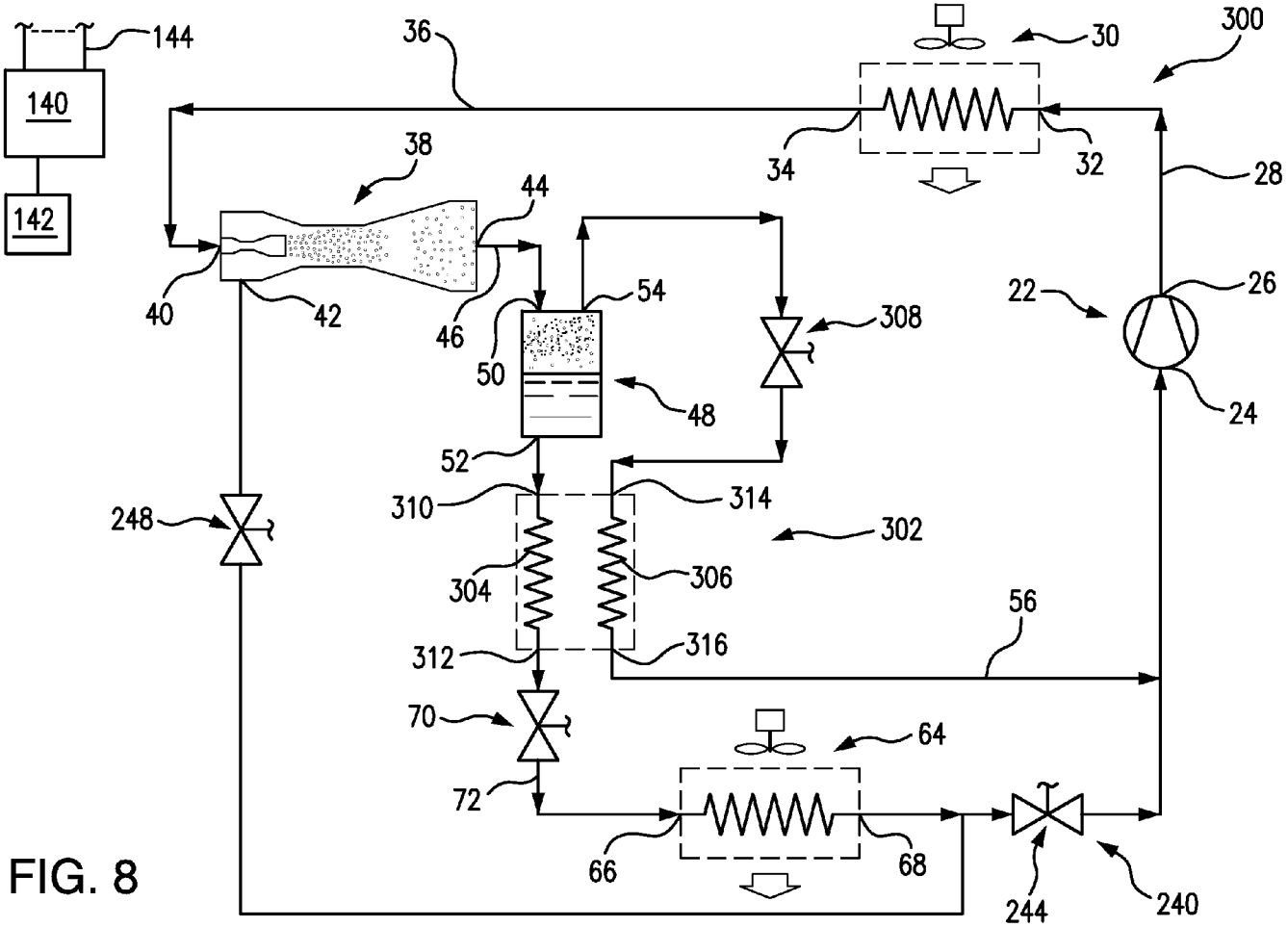
FIG. 8 is a schematic view of the second refrigeration system in a second mode of operation.

In the second mode of operation (a flash tank mode), the valve 248 is closed and the valve 244 is opened (FIG. 8). However, the economizer heat exchanger 302 is utilized by first expanding the flow along the line 56 in the second expansion device 308. That flow is then heated by heat transfer from refrigerant passing along leg 304 to refrigerant passing along leg 306.

Figure 10:
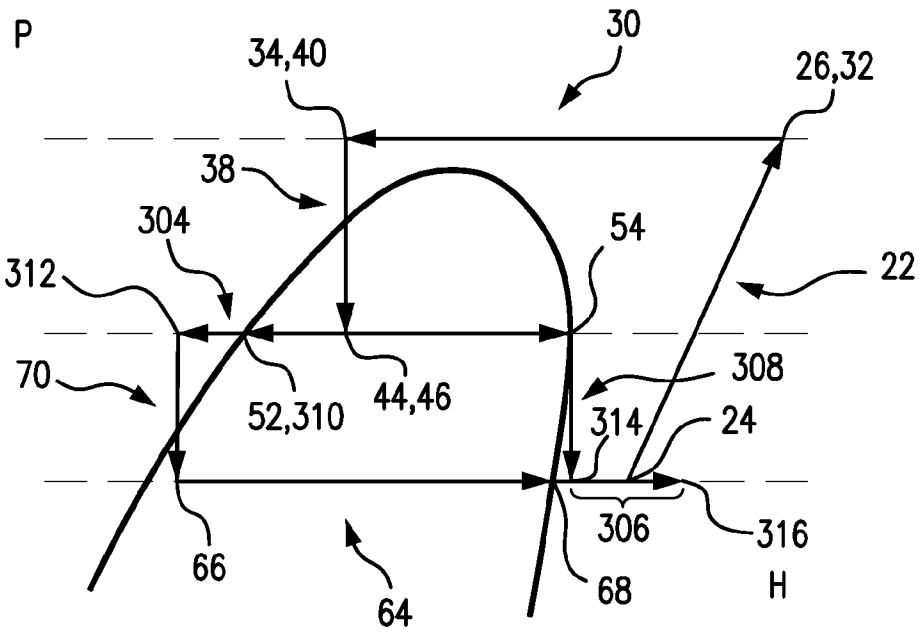
FIG. 10 is a simplified pressure-enthalpy diagram of the second refrigeration system in the second mode of operation.
Figure 9:
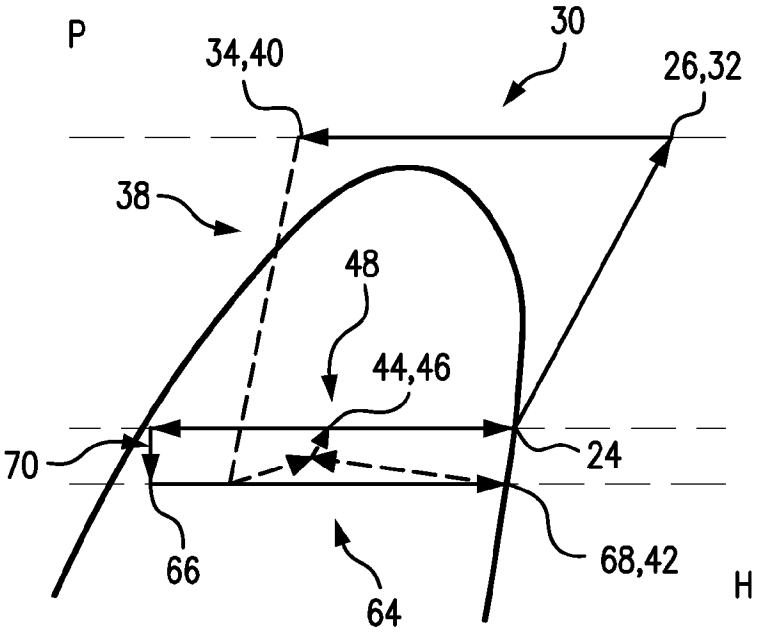
FIG. 9 is a simplified pressure-enthalpy diagram of the second refrigeration system in the first mode of operation.

FIGS. 9 and 10 are respective pressure-enthalpy diagrams for the system 300 in the first and second modes. As with the system 200, the first mode may be used for relatively high load or high ambient temperature conditions whereas the second mode may be used for lower load or temperature conditions. The cycle of FIG. 9 is similar to a basic ejector cycle. In the FIG. 10 mode, the expansion device 308 and heat exchanger 302 are brought fully into play. For the cycle of FIG. 10, the expansion device 308 is regulated to support the pressure in the separator at a value that will allow for sufficient pressure difference across the expansion device 70 for it to operate properly (e.g., at least two Bars); and heat exchanger 302 is active in sub-cooling the refrigerant in line 304 while heating line 306. The refrigerant state entering the compressor at 24 results from the mixing of the heat exchanger exit 314 and the evaporator exit 68. The respective outlets of the leg 306 and the evaporator 64 could be at slightly different conditions averaging to form the suction condition.

An exemplary use of the system 300 is in a supermarket refrigeration application. The compressor(s) and gas cooler are remote to the evaporator(s). For example, a single central (e.g., rooftop or other outdoor) unit having the compressor(s), gas cooler, and ejector may be used to feed one or more remote evaporators (e.g., in individual refrigerated cases).

In a prior art baseline non-ejector system that uses $CO_2$ as the refrigerant, a flash tank is used to take a pressure drop between the gas-cooler and evaporators. A back-pressure regulator valve is used on the vapor outlet to control the pressure of the flash tank to 35 bars. The purpose of this is to provide relatively low pressure refrigerant liquid to the evaporator supply lines that run throughout the store. If the full pressure of the $CO_2$ at the gas-cooler exit were used instead, the cost of the lines (which are many and long) would be much higher. However, in order to ensure that there is enough pressure to operate the evaporator control valves (typically EXVs) which are co-located with the evaporators, the pressure in the tank is not allowed to drop below 35 bars.

In the non-ejector mode of FIGS. 8 and 10, the refrigerant flow/stream entering the compressor is formed by the merging of two streams: one stream is from heat exchanger 302 after expansion in the expansion device 308 and another stream is from the evaporator 64. The pressures of the refrigerant from the two flows are the same level but the temperature is different before mixing.

The load profile in a supermarket can be classified by the following three categories: 1) pull-down (or startup); 2) daytime operation; and 3) nighttime operation. Generally, little time is spent in pull-down, and it is not a significant contributor to yearly power consumption. Both daytime and nighttime are steady operation conditions. Daytime, when compared to nighttime is characterized by higher ambient temperatures and higher loads. The higher loads result mostly from customer activity. During daytime the customers may open and close the display cases frequently while during nighttime the display cases remain closed. Another characteristic of supermarket applications is that the evaporator temperature setpoint remains constant.

During steady state operation, the ejector cycle has significantly higher efficiency than the baseline cycle when the ambient temperature is high, because a high ambient temperature results in a high temperature difference between the gas-cooler and display case temperatures. Also, the ejector cycle may have significantly higher efficiency than the baseline when the loads are high. At low loads and low ambient temperature the baseline cycle (the second mode) is nearly as efficient as the ejector cycle (the first mode). Although from an efficiency perspective the ejector cycle could be run under these conditions, it may be undesirable to use do to the fact that the ejector may not be able to support a sufficient pressure rise between the remote evaporators and flash tank to allow proper operation of the expansion devices. This is because, as the motive inlet pressure drops and the temperature difference between the gas-cooler and the evaporators decreases, the work recovery potential also decreases.

The mode switching is driven in response to the pressure rise from the secondary inlet of the ejector to the flash tank (which is nominally equal to the pressure at the outlet of the ejector). The system manufacturer may determine a minimum pressure rise which is allowable for a given application. Such minimum pressures may be a function of the expansion devices used and the lengths and diameters of the lines (because longer lines of smaller diameter will produce a greater pressure drop thus leaving less pressure drop for the operation of the valve itself). A typical value may be 3 bar. A model is created for the system which predicts the potential ejector pressure rise as a function of ambient temperature, evaporator saturated refrigerant temperature and compressor speed. If in the second mode, the controller senses these three values and predicts the ejector pressure rise. If it is greater than the minimum setpoint pressure rise, then the controller switches to the first mode. The model parameters may be self-tuned by the controller; that is, the actual pressure rise produced by the ejector at different operating conditions in the first mode may be used to back-calculate proper model parameters. If the system is in the first mode, then the controller senses the ejector pressure rise. If it is less than the minimum setpoint pressure rise, then the controller switches to economizer mode.

The variable control actuators of the exemplary system 300 are: 1) the gas-cooler fan 30 speed; 2) the needle of the variable ejector 38; 3) the compressor 22 speed; 4) the orifice of the evaporator expansion device 70; and 5) the orifice of the flash tank pressure regulator (308). The gas-cooler, ejector and compressor are used in such a way that is consistent with system (200), and with the baseline prior art ejector cycle. Their control is not affected by the system operation mode.

In economizer mode, the ejector 38 acts as the HPV (high pressure valve), which is used to maintain the high side pressure at an optimum preset target value responsive to sensed refrigerant temperature leaving the gas cooler. This control is consistent with that described for system 200.

In a baseline system, without an ejector, the flash tank pressure may be held at 35 bar by a pressure regulating valve. In the exemplary system 300, this valve 308 is replaced by either an EXV with a large opening, or some other valve or set of valves that can serve its dual purpose. In the first mode, there should be as little restriction as possible in this line. An EXV would be wide open. In the second mode, the EXV may be used to control the flash tank pressure. The wider the opening of the EXV 308 is, the lower the pressure of the flash tank is, and vise versa.

Figure 11:
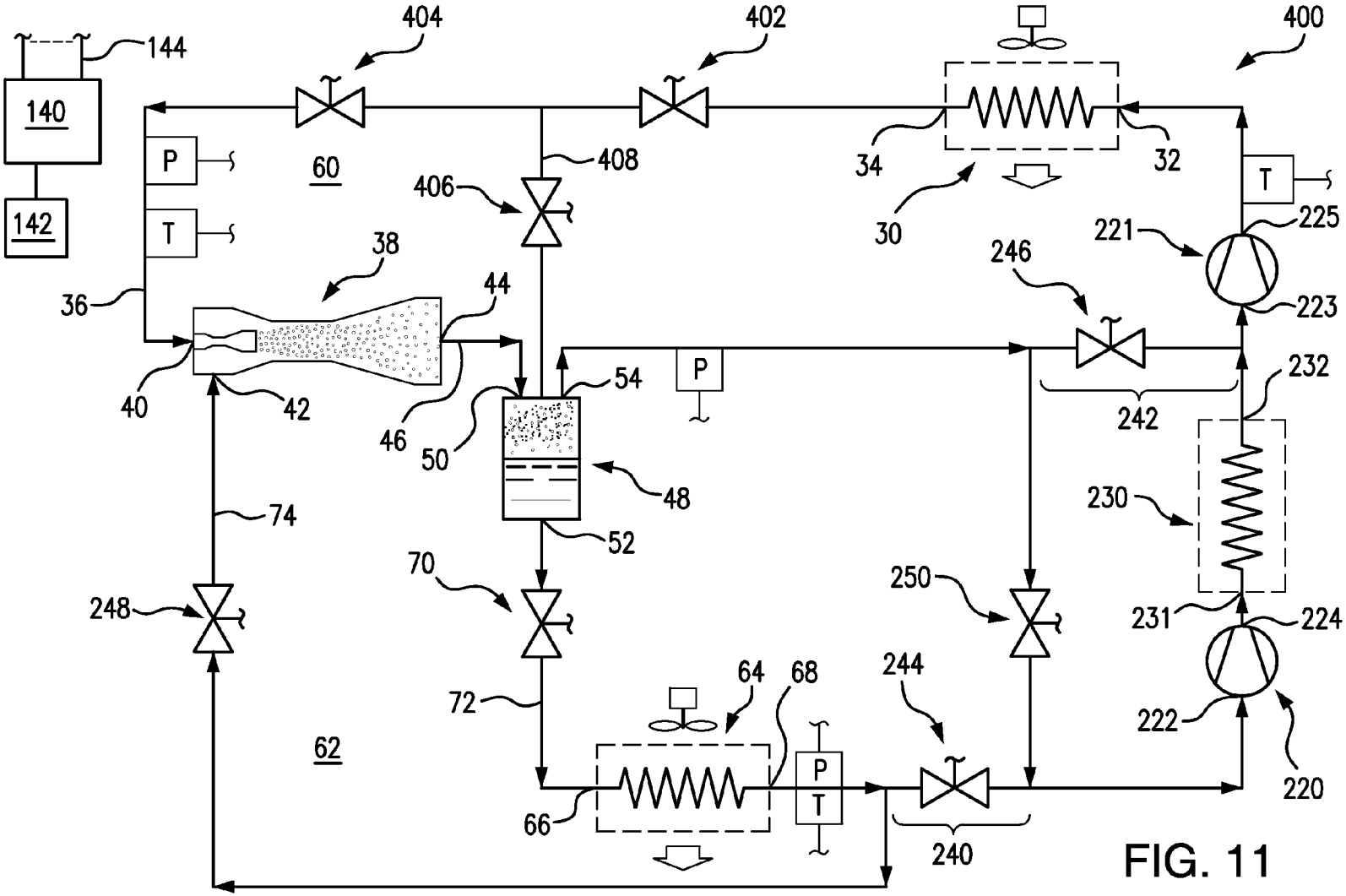
FIG. 11 is a schematic view of a third refrigeration system in a first mode of operation.
Figure 12:
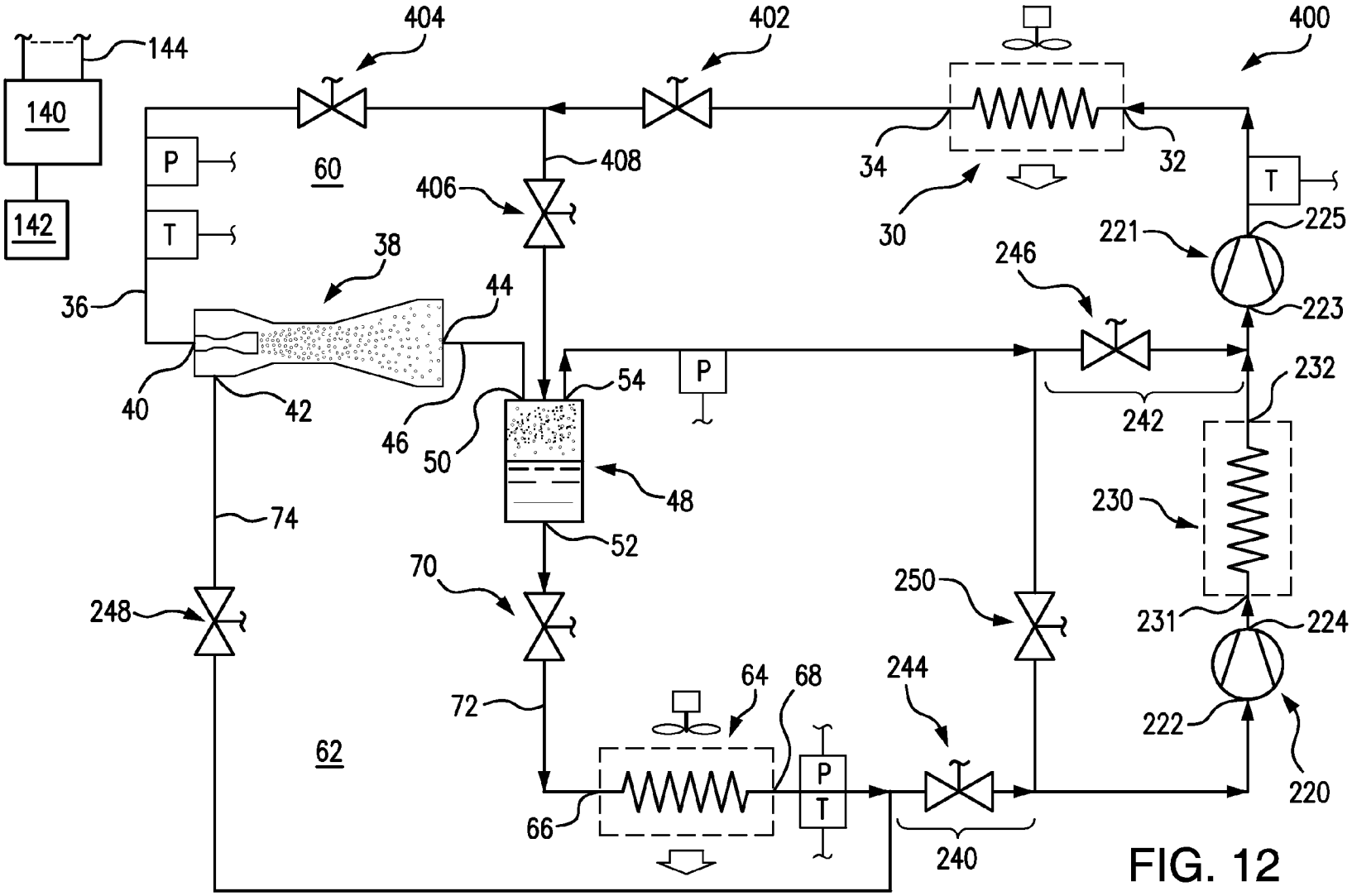
FIG. 12 is a schematic view of the third refrigeration system in a second mode of operation.

FIG. 11 shows an alternate system 400 which may share basic structural and operational details with the systems 20 and 200. In this system, a separate HPV 402 is downstream of the heat rejection heat exchanger/gas cooler 30 and is used to control the high side pressure, and the ejector 38 may be either controllable or non-controllable. The exemplary HPV is located at the gas-cooler exit 34. Two valves 404, 406 (e.g., bistatic solenoid valves) are added, along with an additional line 408 which connects/branches from the exit of the HPV directly into the flashtank/separator 48. One of the bistatic valves is located in this line, while the other is located in line 36 between the HPV exit and the ejector primary inlet 40. In the first (ejector) mode of operation valve 406 is closed and valve 404 is open. In the second (economizer) mode of operation (FIG. 12), bistatic valve 406 is open and bistatic valve 404 is closed. In the first mode, if the ejector is controllable, then the HPV may remain fully open while the ejector 38 serves the function of high-side pressure control. In the second mode, or in the first mode with a non-controllable ejector, the HPV is used for high-side pressure control. The remainder of the actuators are controlled the same as for system 200. The respective thermodynamic cycles of these two modes are also essentially represented by FIGS. 5 and 6.

Figure 13:
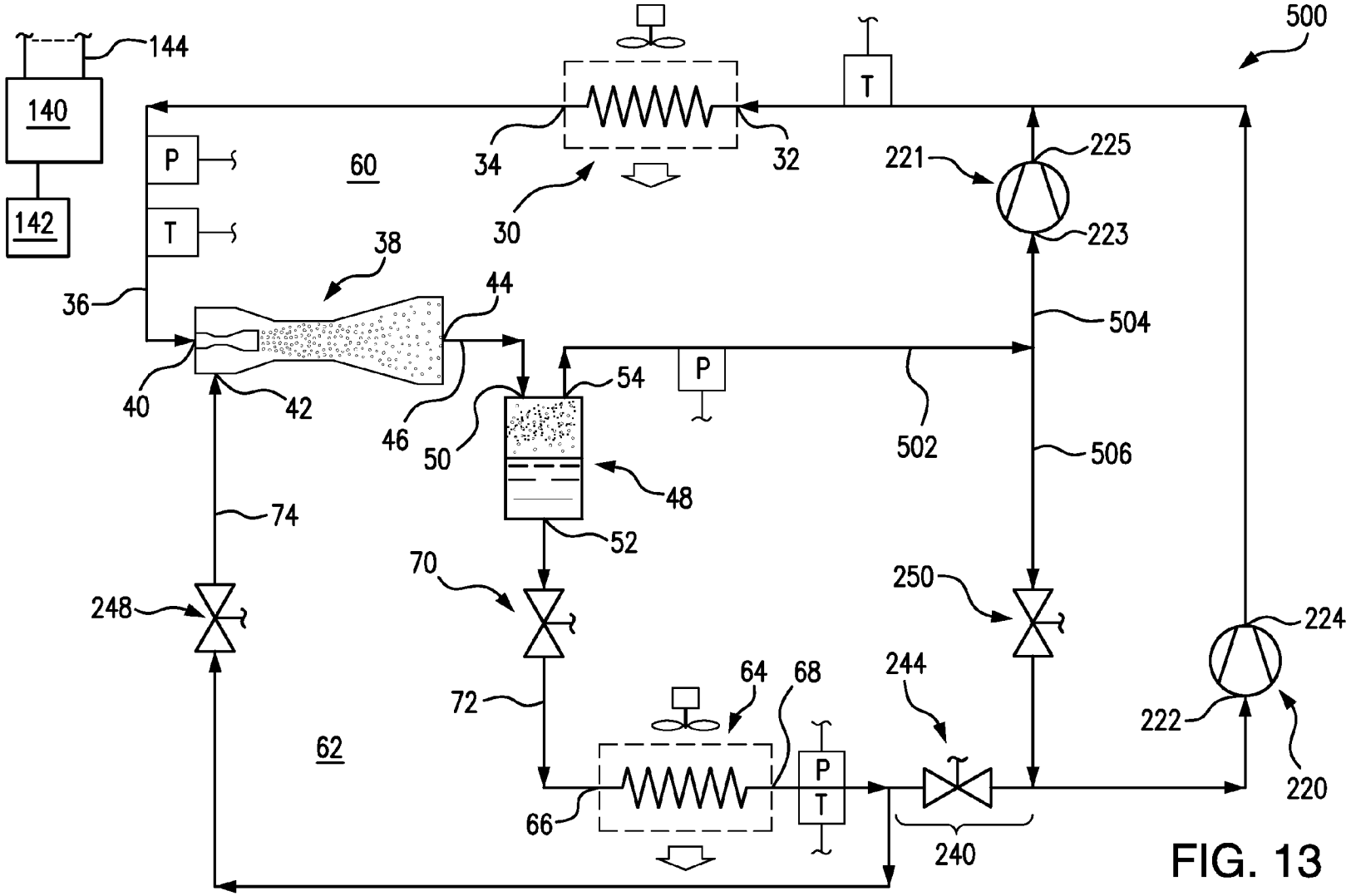
FIG. 13 is a schematic view of a fourth refrigeration system in a first mode of operation.
Figure 14:
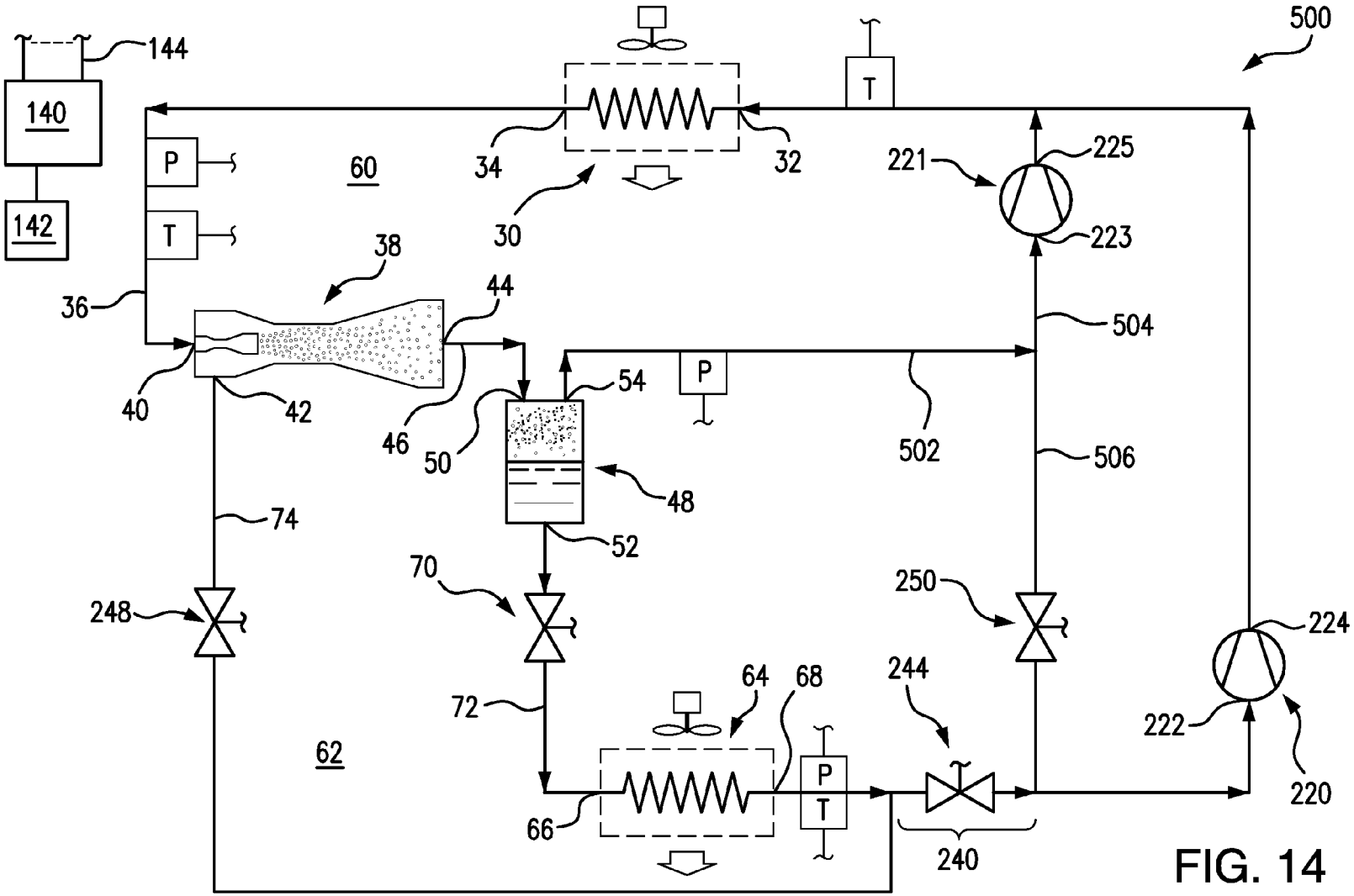
FIG. 14 is a schematic view of the fourth refrigeration system in a second mode of operation.
Figure 15:
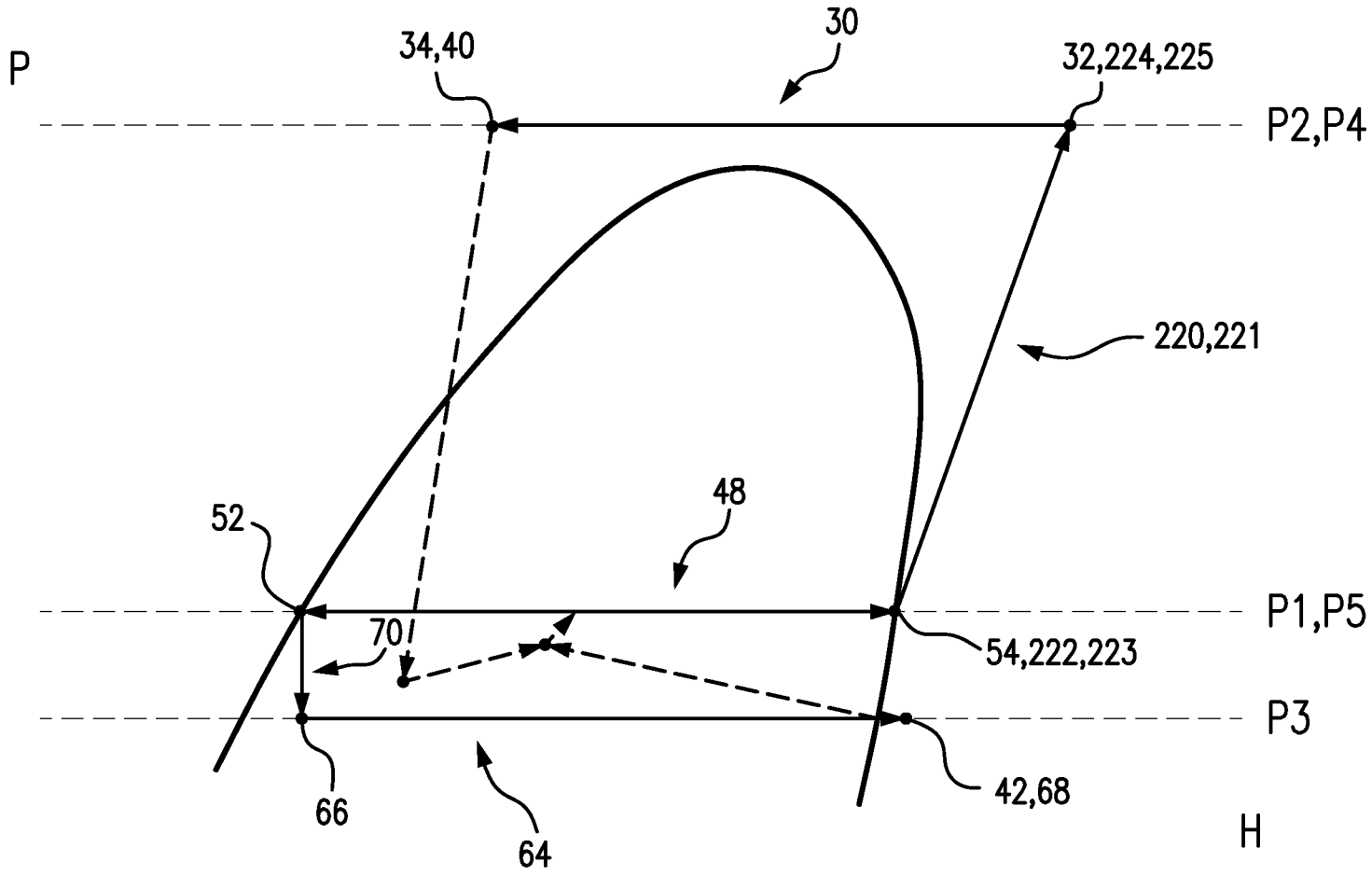
FIG. 15 is a simplified pressure-enthalpy diagram of the fourth refrigeration system in the first mode of operation.
Figure 16:
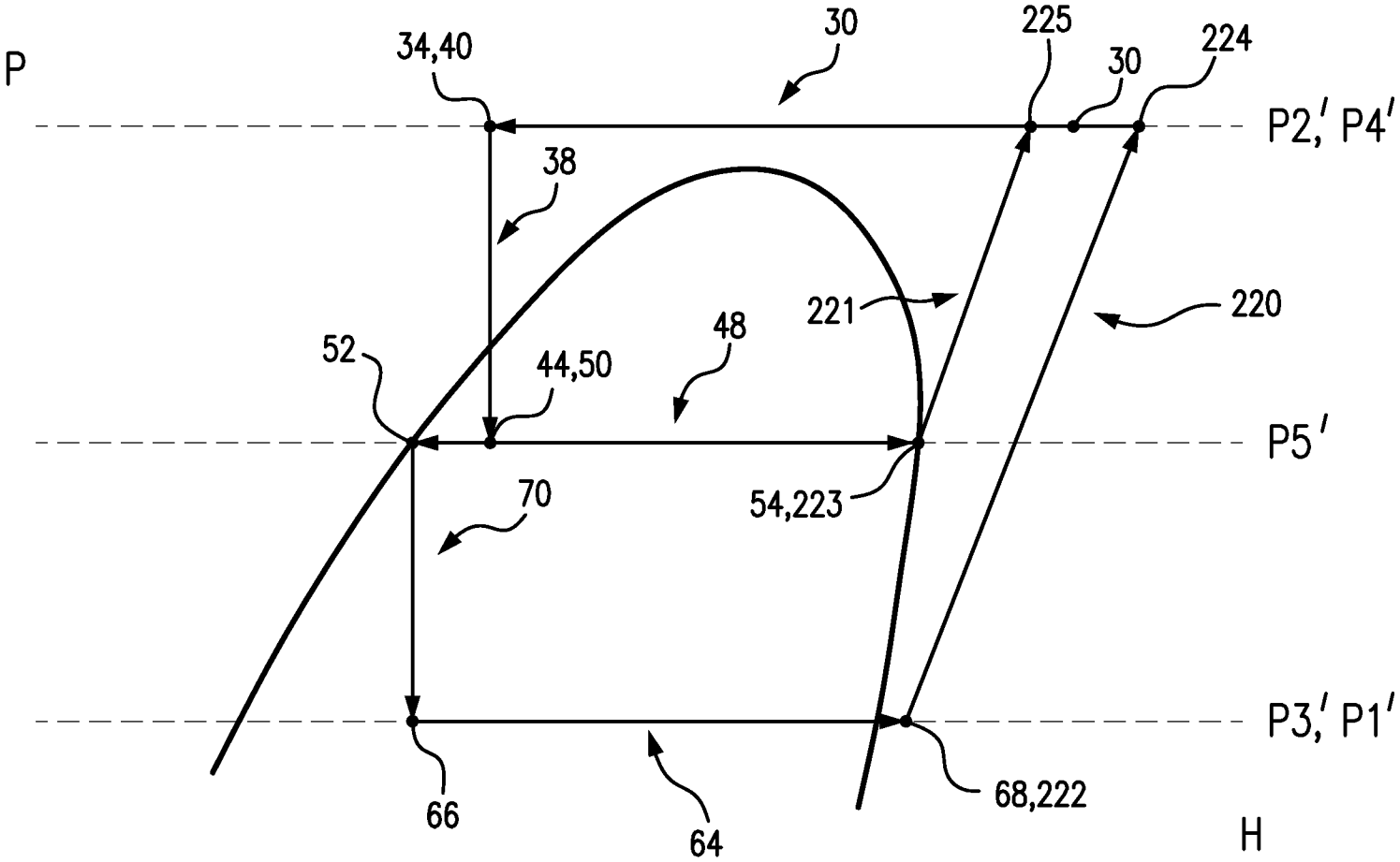
FIG. 16 is a simplified pressure-enthalpy diagram of the fourth refrigeration system in the second mode of operation.

FIG. 13 shows an alternate system 500 which may share basic structural and operational details with the systems 20 and 200. In this system the two compressors 220 and 221 are circuited in parallel rather than in series. In this mode, the compressors 220 and 221 are effectively in parallel rather than in an interrupted series. A line 502 from the separator gas outlet 54 branches into a branch 504 feeding the suction port 223 of the second compressor and a branch 506 feeding the suction port of the first compressor via the valve 250. Compressor 220 compresses the refrigerant from P1 to P2 (or P1' to P2'). There is no intercooler. Bistatic solenoid valve 246 may be removed. In the first mode, with bistatic valve 250 open and bistatic valve 244 closed, both compressors receive refrigerant from the separator outlet 54 at P1, and both compressors compress the refrigerant to pressure P2. On a pressure-enthalpy diagram they act as a single compressor. In the FIG. 14 second mode, with bistatic valve 244 open and bistatic valve 250 closed, compressor 220 receives refrigerant from the evaporator at pressure P3' and compresses it to P2'. Compressor 221 receives refrigerant from separator exit 54 at pressure P4' and compresses it to P2'. Before they enter the gas cooler the two flows mix.

Figure 17:
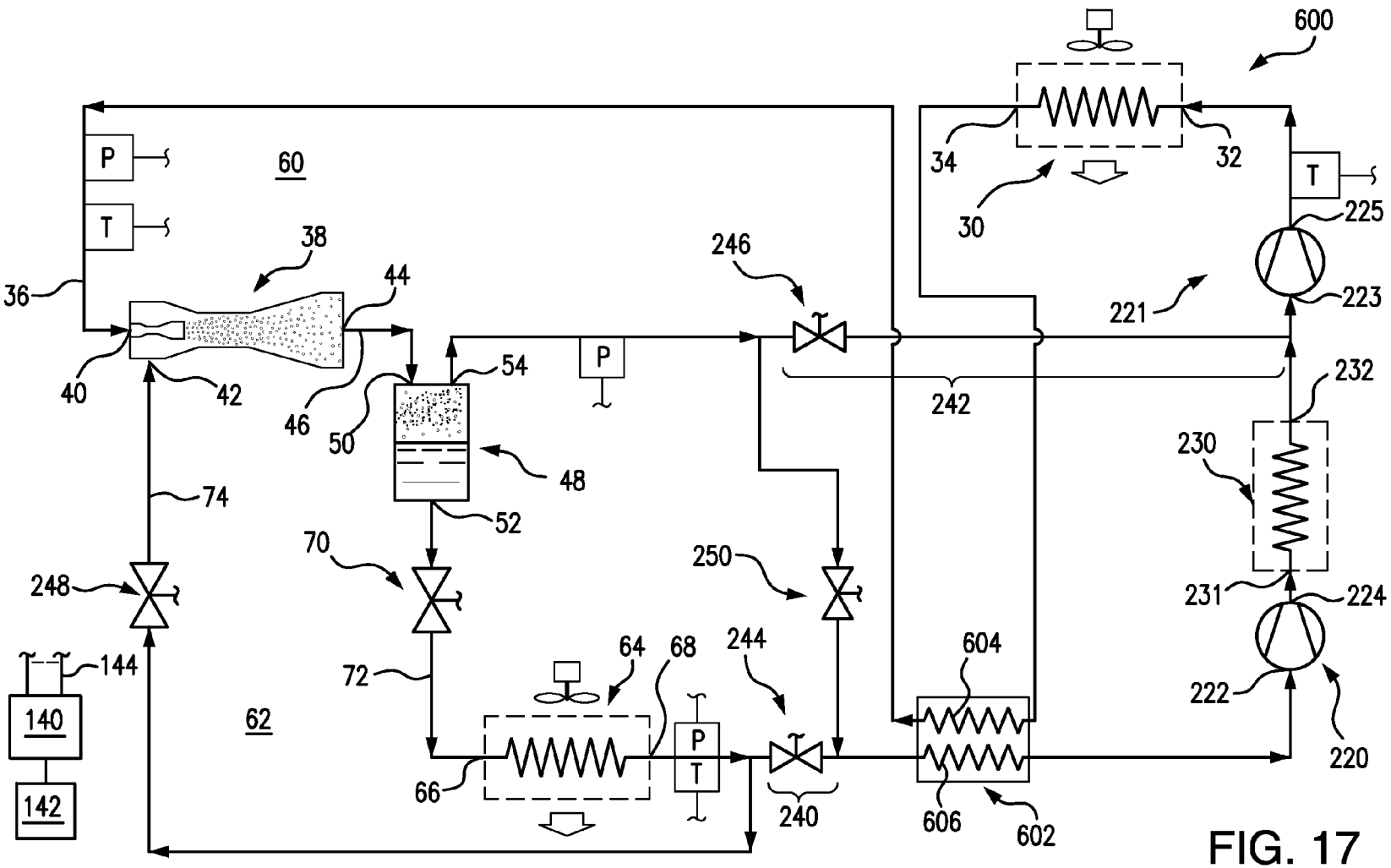
FIG. 17 is a schematic view of a fifth refrigeration system in a first mode of operation.
Figure 18:
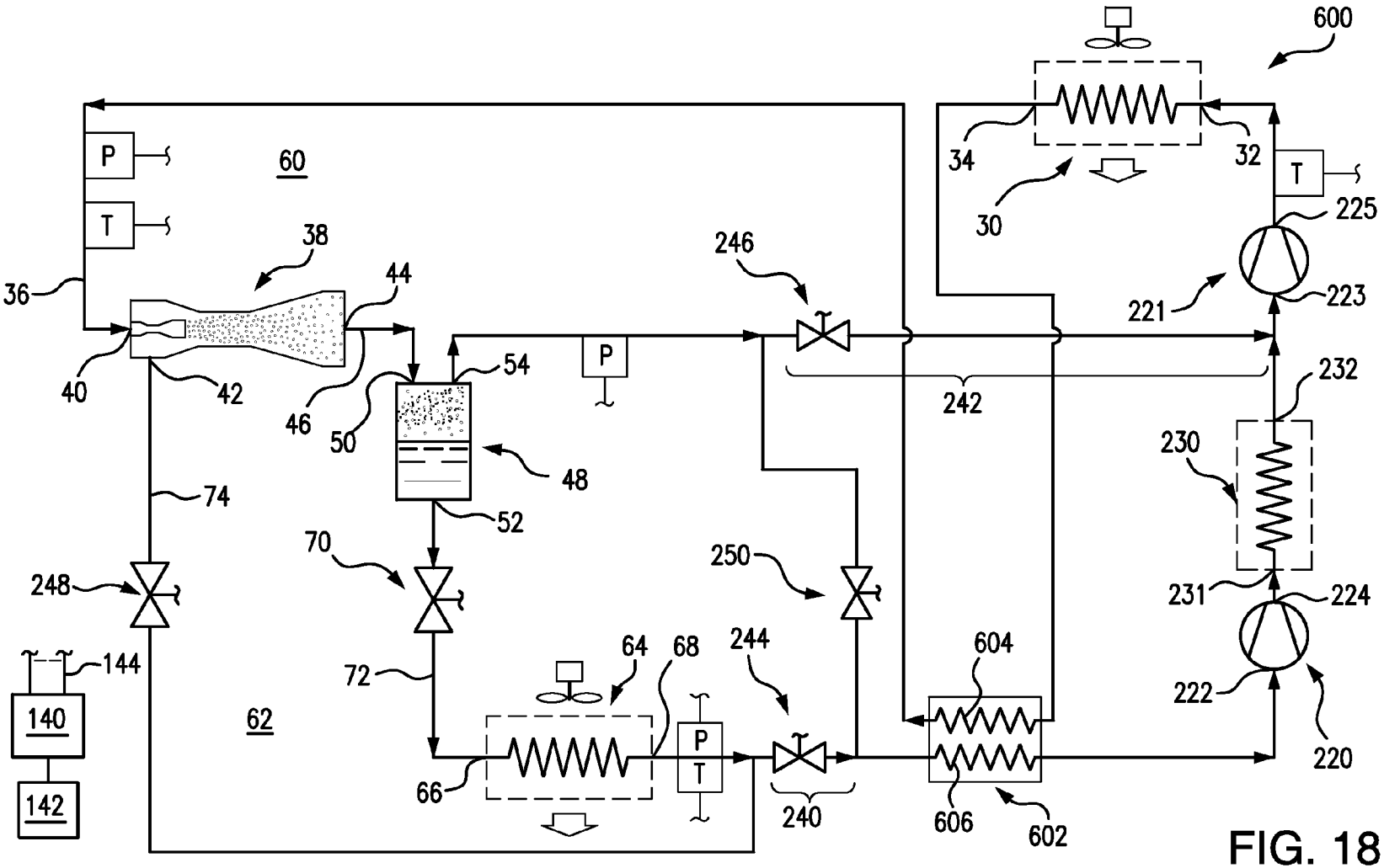
FIG. 18 is a schematic view of the fifth refrigeration system in a second mode of operation.

FIGS. 17 and 18 show an alternate system 600 (in respective first (ejector) and second (economizer) modes) which is the same as system 200 except that a suction-line heat exchanger (SLHX) 602 has been added. The SLHX exchanges heat from the warm fluid at the gas cooler exit (in a leg 604) to the cooler vapor at the compressor suction inlet (in a leg 606). In so doing it increases the cooling available from a given flow rate of refrigerant, but at the cost of higher compressor power. Depending on the system and its operating conditions, a SLHX may have a net positive effect on system efficiency. In a similar manner a suction line heat exchanger may also be added to system 300.

The systems may be fabricated from conventional components using conventional techniques appropriate for the particular intended uses.

Although an embodiment is described above in detail, such description is not intended for limiting the scope of the present disclosure. It will be understood that various modifications may be made without departing from the spirit and scope of the disclosure. For example, when implemented in the remanufacturing of an existing system or the reengineering of an existing system configuration, details of the existing configuration may influence or dictate details of any particular implementation. Accordingly, other embodiments are within the scope of the following claims.

What is claimed is:

1. A system (200; 300; 400; 500; 600) comprising:
a compressor (22; 220, 221);
a heat rejection heat exchanger (30) coupled to the compressor to receive refrigerant compressed by the compressor;
an ejector (38) having:
a primary inlet (40);
a secondary inlet (42); and
an outlet (44);
a heat absorption heat exchanger (64);
a separator (48) having:
an inlet (50) coupled to the outlet of the ejector to receive refrigerant from the ejector;
a gas outlet (54); and
a liquid outlet (52); and
one or more valves (244, 246, 248, 250) and a controller (140) configured to operate the one or more valves to switch the system between:
a first mode wherein:
refrigerant passes sequentially from the heat rejection heat exchanger, through the ejector primary inlet, out the ejector outlet, to the separator;
a first flow from the separator gas outlet passes through the compressor to the heat rejection heat exchanger; and
a second flow from the separator liquid outlet passes through the heat absorption heat exchanger and through the ejector secondary inlet; and
a second mode wherein:
flow through the ejector secondary inlet is blocked:
refrigerant passes from the heat rejection heat exchanger to the separator;
a first flow from the separator gas outlet passes to the compressor; and
a second flow from the separator liquid outlet passes through the heat absorption heat exchanger to the compressor bypassing the ejector.

2. The system (200; 600) of claim 1 wherein:
the compressor comprises a first compressor (220) and a second compressor (221); in the first mode:
refrigerant passes from the heat rejection heat exchanger, through the ejector primary inlet, out the ejector outlet, to the separator;
the first flow from the separator passes through the first compressor and the second compressor to the heat rejection heat exchanger; and
the second flow from the separator passes through the heat absorption heat exchanger and through the ejector secondary inlet; and
in the second mode:
refrigerant passes from the heat rejection heat exchanger, through the ejector primary inlet, out the ejector outlet, to the separator;
the first flow from the separator passes to the second compressor, bypassing the first compressor; and
the second flow from the separator passes through the heat absorption heat exchanger and the first compressor to join the first flow and pass through the second compressor to the heat rejection heat exchanger.

3. The system of claim 2 wherein:
the first and second compressors are separately powered.

4. The system of claim 2 wherein:
the first and second compressors are separate stages of a single compressor.

5. The system of claim 2 wherein:
a first valve (244) of said one or more valves is positioned between the heat absorption heat exchanger and the first compressor; and
a second valve (248) of the one or more valves is positioned between the heat absorption heat exchanger and the secondary inlet.

6. The system of claim 5 wherein:
a third valve (246) of said one or more valves is positioned between the separator gas outlet and the second compressor; and
a fourth valve (250) of the one or more valves is positioned between the separator gas outlet and inlet of the first compressor.

7. The system of claim 5 wherein:
the first valve and the second valve are bistatic on-off valves.

8. The system of claim 2 wherein:
a first valve (246) of said one or more valves is positioned between the separator gas outlet and the second compressor; and
a second valve (250) of the one or more valves is positioned between the separator gas outlet and an inlet of the first compressor.

9. The system (400) of claim 1 wherein:
the compressor comprises a first compressor (220) and a second compressor (221); in the first mode:
refrigerant passes from the heat rejection heat exchanger, through the ejector primary inlet, out the ejector outlet, to the separator;
the first flow from the separator passes through the first compressor and the second compressor to the heat rejection heat exchanger; and
the second flow from the separator passes through the heat absorption heat exchanger and through the ejector secondary port; and
in the second mode:
refrigerant passes from the heat rejection heat exchanger to the separator, bypassing the ejector;
the first flow from the separator passes to the second compressor, bypassing the first compressor; and
the second flow from the separator passes through the heat absorption heat exchanger and the first compressor to join the first flow and pass through the second compressor to the heat rejection heat exchanger.

10. The system (500) of claim 1 wherein:
the compressor comprises a first compressor (220) and a second compressor (221); in the first mode:

refrigerant passes from the heat rejection heat exchanger, through the ejector primary inlet, out the ejector outlet, to the separator;

the first flow from the separator splits into portions respectively passing through the first compressor and the second compressor to the beat rejection heat exchanger; and the second flow from the separator passes through the heat absorption heat exchanger and through the ejector secondary inlet; and in the second mode:

refrigerant passes from the heat rejection heat exchanger, through the ejector primary inlet, out the ejector outlet, to the separator;

the first flow from the separator passes to the second compressor, bypassing the first compressor; and the second flow from the separator passes through the heat absorption heat exchanger and the first compressor to join the first flow and pass through the heat rejection heat exchanger, bypassing the second compressor.

11. The system of claim 10 wherein:

the first and second compressors are separately powered.

12. The system of claim 10 wherein:

the first and second compressors are separate stages of a single compressor.

13. The system of claim 1 further comprising:

a controllable expansion device (70) between the separator liquid outlet and the heat absorption heat exchanger.

14. The system of claim 13 further comprising:

a refrigerant-refrigerant heat exchanger (302) having:

a first leg (304) between the separator liquid outlet and the controllable expansion device; and a second leg (306) between the separator gas outlet and the compressor; and a second controllable expansion device (308) between the separator gas outlet and the second leg.

15. The system of claim 1 wherein:

the separator is a gravity separator;

a single phase gas flow exits the gas outlet in both the first and second modes; and a single phase liquid flow exits the liquid outlet in both the first and second modes.

16. The system of claim 1 wherein:

the system has no other separator.

17. The system of claim 16 wherein:

a first valve (246) of said one or more valves is positioned between the separator gas outlet and the second compressor; and a second valve (250) of the one or more valves is positioned between the separator gas outlet and an inlet of the first compressor.

18. The system of claim 1 wherein:

the system has no other ejector.

19. The system of claim 1 wherein the one or more valves comprises one or more of:

a controllable valve (248) having: an open condition permitting flow from the heat absorption heat exchanger to the compressor; and a closed condition preventing said flow from the heat absorption heat exchanger to the ejector secondary inlet; and a controllable valve (244) having: an open condition permitting flow from the heat absorption heat exchanger to the compressor; and a closed condition preventing said flow from the heat absorption heat exchanger to the compressor.

20. The system of claim 1 wherein:

refrigerant comprises at least 50% carbon dioxide, by weight.

21. The system of claim 1 wherein:

a first valve (244) of said one or more valves is positioned between the heat absorption heat exchanger and the compressor; and a second valve (248) of the one or more valves is positioned between the heat absorption heat exchanger and the secondary inlet.

22. The system of claim 1 wherein the one or more valves comprises:

a controllable valve (248) having: an open condition permitting flow from the heat absorption heat exchanger to the ejector secondary inlet; and a closed condition preventing said flow from the heat absorption heat exchanger to the ejector secondary inlet; and a controllable valve (244) having: an open condition permitting flow from the heat absorption heat exchanger to the compressor; and a closed condition preventing said flow from the heat absorption heat exchanger to the compressor.

23. A method for operating a vapor compressor system, the system comprising:

a compressor (20; 220, 221);

a heat rejection heat exchanger (30);

an ejector (38) having:

a primary inlet (40);

a secondary inlet (42); and an outlet (44);

a heat absorption heat exchanger (64);

a separator (48) having:

an inlet (50);

a gas outlet (54); and a liquid outlet (52);

a controller (140); and one or more valves (244, 246, 248, 250) positioned to allow switching of the system between a first mode and a second mode, the method comprising, under control of the controller:

operating in the first mode wherein:

refrigerant passes sequentially from the heat rejection heat exchanger, through the ejector primary inlet, out the ejector outlet, to the separator;

a first flow from the separator gas outlet passes through the compressor to the heat rejection heat exchanger; and a second flow from the separator liquid outlet passes through the heat absorption heat exchanger and through the ejector secondary inlet; and switching the system to a second mode wherein:

flow through the ejector secondary inlet is blocked;

refrigerant passes from the heat rejection heat exchanger to the separator inlet;

a first flow from the separator gas outlet passes to the compressor; and a second flow from the separator liquid outlet passes through the heat absorption heat exchanger and to the compressor, bypassing the ejector secondary inlet.

* * * * *